United States Patent [19]

Slabon et al.

[11] 4,076,308

[45] Feb. 28, 1978

[54] CHAIR

[75] Inventors: Siegfried Slabon, Salzhemmendorf; Klaus Franck, Elze, both of Germany

[73] Assignee: Wilkhahn, Wilkening & Hahne, Eimbeckhausen, Germany

[21] Appl. No.: 798,493

[22] Filed: May 19, 1977

[30] Foreign Application Priority Data

May 22, 1976 Germany ..... 2623024

[51] Int. Cl.[2] ..... A47C 1/022

[52] U.S. Cl. ..... 297/313; 297/327; 248/397

[58] Field of Search ..... 297/300–306, 297/325, 326, 327, 337, 355, 313; 248/371, 384, 375, 382, 378, 397, 398

[56] References Cited

U.S. PATENT DOCUMENTS

| | | | |
|---|---|---|---|
| 1,216,755 | 2/1917 | Whitten | 248/384 |
| 2,310,346 | 2/1943 | Bell | 297/337 X |
| 2,463,257 | 3/1949 | Fox | 248/375 X |
| 2,687,166 | 8/1954 | Hamilton | 297/326 |
| 2,818,911 | 1/1958 | Syak | 297/303 |
| 3,712,666 | 1/1973 | Stoll | 297/313 |
| 3,784,147 | 1/1974 | Harder | 297/337 |
| 3,880,465 | 4/1975 | Scheben | 297/355 |

*Primary Examiner*—Francis K. Zugel

*Attorney, Agent, or Firm*—Larson, Taylor and Hinds

[57] ABSTRACT

The chair described has a single support leg carrying a support plate. An elongate member is pivotally secured to the support plate. A back rest is rigidly secured to the rear end of the elongate member while a seat portion bearing support is pivotally secured to the front end of the elongate member. Separate means are provided on the support plate to vary the inclination of the rear end of the elongate member, and therefore the back rest, and to vary the inclination of the bearing support and therefore the seat portion which it supports.

9 Claims, 3 Drawing Figures

CHAIR

BACKGROUND OF THE INVENTION

1. Field of the Invention

The present invention relates to chairs.

2. Description of the Prior Art

Chairs having a single vertical leg are known. Such chairs have a support plate supporting a seat portion in which the seat portion is hinged thereto in the vicinity of the back rest. The back rest is coupled to the support plate by means of a piston and cylinder assembly to enable the angle of inclination of the back rest to be varied.

The disadvantage of such a chair is that any change in the angle of inclination of the back rest is accompanied by a similar change in the angle of inclination of the seat portion. Thus for example when the back rest is pivoted forwardly towards the occupant, the rear edge of the seat portion drops and accordingly the front edge of the seat portion is effectively lifted to cause the legs of the occupant of the chair to be lifted off the floor, which can be unpleasant.

To counter the effect produced by the pivotal displacement of the back rest, a mechanical spring, for example a leaf spring, whereof the rigidity is set once and for all at the production works, is installed on the support. The leaf spring results in a relatively large structural height of the support in which it must be housed.

It is an object of the invention to provide an improved chair. A further object of the invention is to provide a chair in which the ratio between the inclination of the back rest and the inclination of the seat portion can be readily adjusted and the need for a mechanical leaf spring is obviated.

SUMMARY OF THE INVENTION

According to the invention there is provided in a chair, leg means, a support plate carried by the leg means, an elongate member having a front edge portion, an intermediate portion and a rear edge portion, pivot means pivotally supporting the intermediate portion of the elongate member on the support plate, a back rest secured to the rear edge portion of the elongate member, a piston and cylinder assembly coupling the rear edge portion of the elongate member to the support plate and being operable to allow the inclination of the back rest to be varied, a seat portion bearing plate, coupling means pivotally securing the bearing plate along the front edge of the elongate member, and resilient pad means slidably mounted on the support plate to carry an intermediate portion of the bearing plate, the resilient pad means being slidable to vary the inclination of the bearing plate with respect to the support plate.

According to the invention there is further provided in a chair, a support plate, an elongate member having two opposite end portions and pivotally supported on the support plate, a back rest rigid with the elongate member at one end portion thereof, a seat portion pivotally secured to the elongate member at the other end portion, first means coupling the support plate and the one end portion of the elongate member to vary the angle of inclination of the back rest, and second means coupling the support plate and the seat portion to vary the inclination of the seat portion.

BRIEF DESCRIPTION OF THE DRAWINGS

A chair embodying the present invention, will now be described by way of example, with reference to the accompanying diagrammatic drawings in which.

DESCRIPTION OF THE PREFERRED EMBODIMENTS

Figure 1:
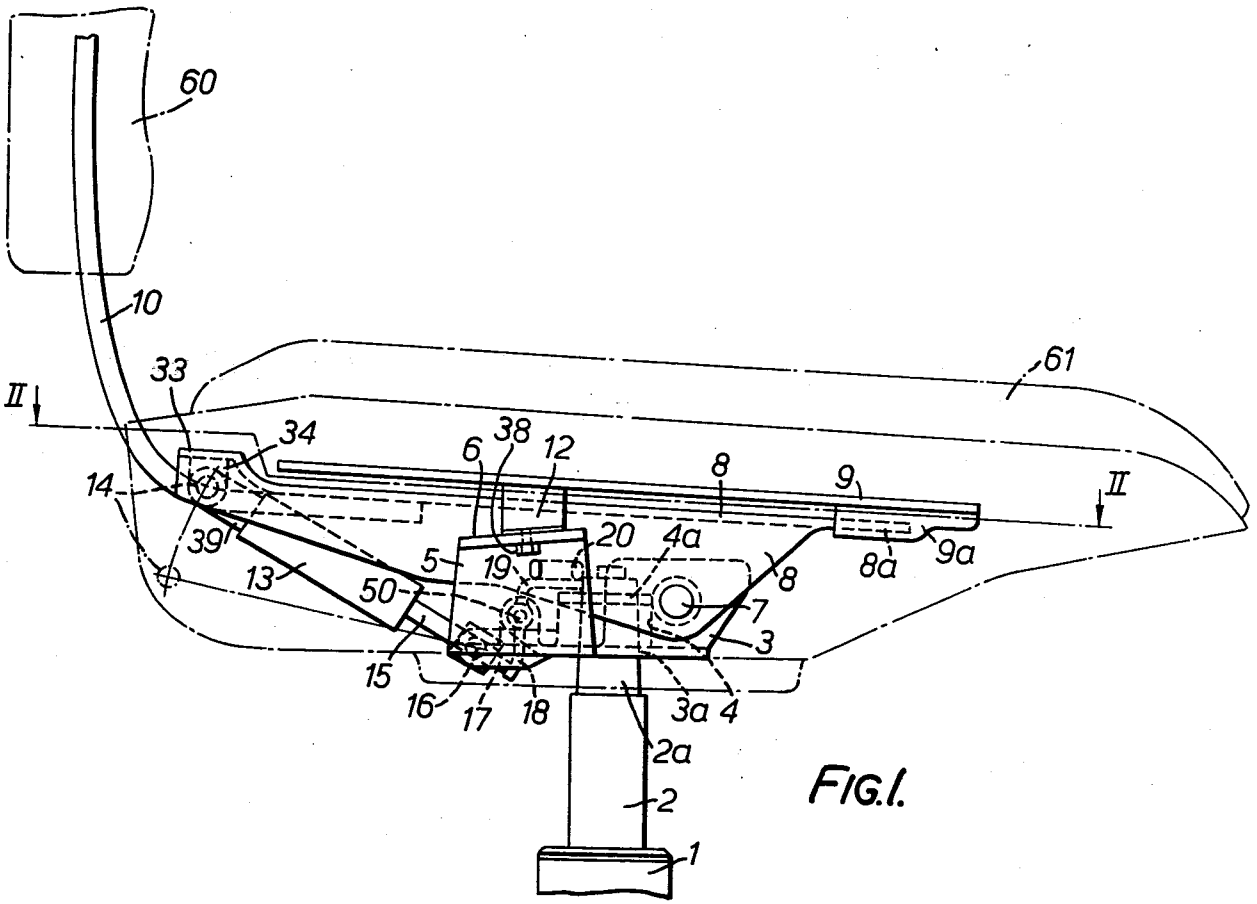
FIG. 1 is a fragmentary side elevation of the chair.
Figure 2:
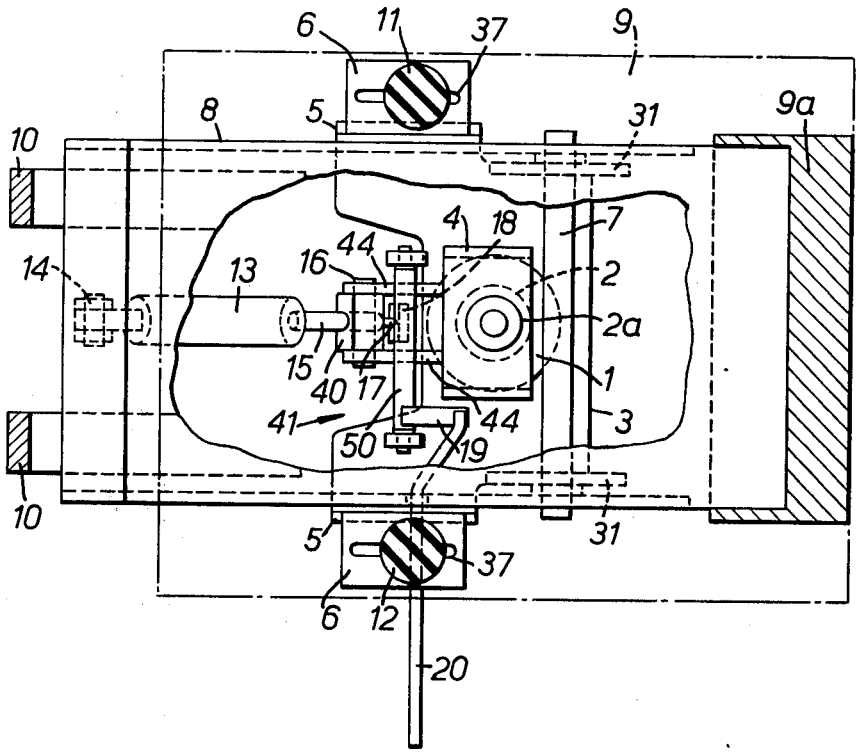
FIG. 2 is a section through the chair of FIG. 1 taken along the line II-II in FIG. 1.
Figure 3:
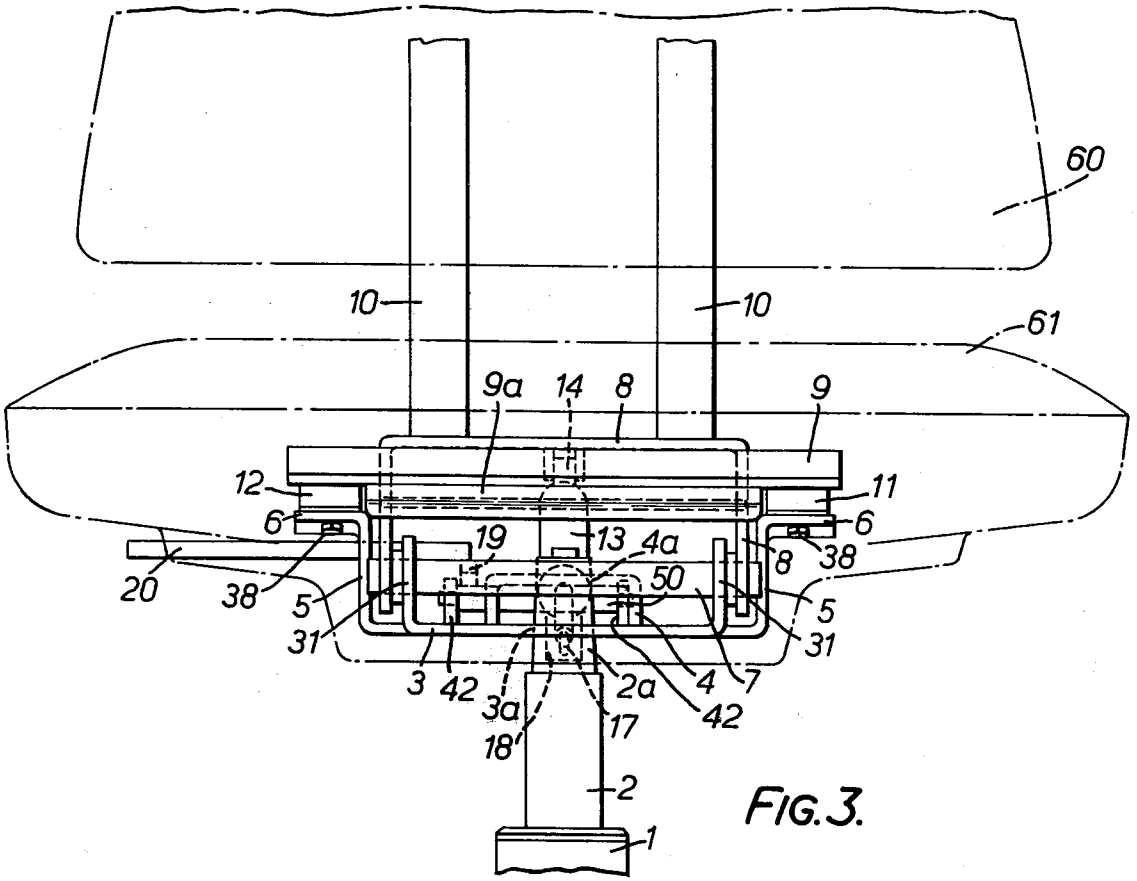
FIG. 3 is a fragmentary front elevation of the chair of FIG. 1.

The chair shown in FIG. 1 includes a back rest 60 and a seat portion 61. A single column cylindrical support 1 slidably houses a piston rod 2. The piston rod 2 can be locked in any relative position with respect to the support by a pneumatic arrangement well known in the art thereby providing a means for adjusting the height of the chair seat. The upper end portion **2*a* of the piston rod 2 is tapered and passes through an opening 3*a* of a support plate 3 as well as through an opening 4*a* in an inverted 'U'-shaped bracket 4 welded to the support plate 3. The upper end portion 2*a* is force fitted into the two openings 3*a* and 4*a* which thus ensures that the support plate 3 is rigidly secured to the upper end of the piston rod 2**.

The support plate 3 has two lateral side walls 5 each of which carries a flange 6 providing a supporting surface.

A portion of the support plate 3 which extends forwardly of the side walls 5 (to the right hand side as viewed in FIG. 1) is of reduced width and is also flanked by a pair of side walls 31. A spindle 7 traverses apertures in both side walls 31 and is rotatably supported by the side walls 31.

The spindle 7 carries an elongate member 8 of generally inverted U-cross section which is thus pivotable about the axis of the spindle 7. The right hand end of the elongate member 8 (as viewed in FIG. 1) projects beyond the right hand extremity of the plate 3 and terminates in a generally horizontal tongue **8*a*. The left hand end of the elongate member 8 projects beyond the left hand end of the member 3**.

A substantially planar seat element bearer 9 carries a pocket **9*a* on its underside along one end portion (the right hand end portion as viewed in FIG. 1). The pocket 9*a* is engaged by the tongue 8*a* of the elongate member 8 which forms a force fit therewith. The bearer 9 due to its own flexibility as well as that of the tongue 8*a*, is effectively pivoted about the joint between the tongue 8*a* and the pocket 9*a*** to a limited extent.

The left hand end portion of the elongate member 8 terminates in a raised housing 33 inside which are housed a pair of parallel downwardly depending parallel lugs 33. The lugs carry a pivot pin 14. A pair of parallel back rest support brackets 10 extend downwardly from the back rest 60 curve under the left hand end of the elongate member, pass on opposite sides of the two lugs 33 and run into contact with the underside of the horizontal part of the elongate member 8 at which point they are welded to the member 8. The backrest brackets 10 support the back rest 60.

A pair of resilient pads 11 and 12 carried by respective flanges 6 project above the upper surface of the member 8 and support an intermediate portion of the bearer 9. The upper surfaces of the flanges 6 are inclined with respect to the horizontal and pads 11 and 12 are wedge-shaped so that by sliding the pads 11 and 12 between an extreme left hand position and an extrme right hand position (as viewed in FIG. 1) the bearer 9 will be caused to pivot about its right hand end. Each pad 11 and 12 is constrained for sliding movement by a bolt 36 which is screw threaded into a respective pad 11 and 12 and slidably engages a slot 37 in a respective flange 6. By screwing up the bolts 36 the pads can be securely held in any selected position of the flanges. It will of course be appreciated that other means than the bolts and the slots can be used to secure and adjust the pads 11 and 12 on the flanges.

By displacing the two pads 11 and 12 along the flanges the ratio of the slope of the seat element bearer 9, to that of the back rest brackets 10 can be varied in a stepless manner. It will be appreciated that the bearer 9 pivots about the tongue 11 and pocket 9 as well as the axis of the spindle 7 while the back rest support brackets 10 pivot only about the axis of the spindle 7.

A pneumatic piston and cylinder assembly for controlling the attitude of the back rest through the back rest brackets 10, includes a piston 15 and a cylinder 13. The cylinder 13 has an apertured lug 39 which is coupled to the lugs 34 by the pivot pin 14. The piston rod 15 carries block 40 at its free end portion. The block 40 is located in a recess 41 in the left hand end of the plate 3 and is pivotally supported by a pivot pin 16 carried by a pair of parallel vertical brackets 44 welded to the plate 3. A release pin 17 projects from the block 40. The release pin when depressed acts to equalise the pressure inside the cylinders on opposite sides of the piston and in this way allows relative displacement between the piston and cylinder. When the release pin 17 is released communication between opposite sides of the piston is blocked and the position of the piston in the cylinder is thereby locked. A release pin actuater 18 is carried by a spindle 50 rotatably. supported by a pair of lugs 42 welded to the support plate 3. A radially projecting arm 19 rigid with the spindle 50 supports a control crank rod 20 at its distal end. The control rod passes through an aperture in one of the side walls 5 to project from one side of the chair in a position where it can be readily grasped by a person seated in the chair. It will be appreciated that to alter the attitude of the back rest of the chair the person seated in the chair rotates the rod 20. This rotates the spindle 50 and causes the actuator 18 to depress the release pin 17. The person seated in the chair can now set the back rest at the required attitude and when this is accomplished the rod 20 rotated again to return it to its original position. By this action the actuator releases the release pin 17 and the back rest is locked in position. To adjust the slope of the seat portion of the chair the occupant of the chair must rise from the chair, undo the bolts 38 and slide them along the slots 37 until the desired inclination of the seat portion is achieved. The bolts are then tightened to lock the pads 11 and 12 into position.

It will be appreciated that the use of resilient pads to adjust the inclination of the seat portion of the chair avoids the more bulky arrangement of leaf springs which were used in previously proposed chairs.

We claim:

1. In a chair, leg means, a support plate carried by the leg means, an elongate member having a front edge portion, an intermediate portion, and a rear edge portion, pivot means pivotally supporting the intermediate portion of the elongate member to the support plate, a back rest secured to the rear edge portion of the elongate member, a piston and cylinder assembly coupling the rear edge portion of the elongate member to the support plate and being operable to allow the inclination of the back rest to be varied, a seat portion bearing plate, coupling means pivotally securing the bearing plate along the front edge of the elongate member, and resilient pad means slidably mounted on the support plate to carry an intermediate portion of the bearing plate, the resilient pad means being slidable to vary the inclination of the bearing plate with respect to the support plate.

2. A chair according to claim 1 wherein the piston and cylinder assembly includes a cylinder secured to the elongate member, a piston slidably housed in the cylinder and having a piston rod secured to the support plate, a release member projecting from the piston rod and operable upon displacement to equalise the pressure in the cylinder and thus allow relative displacement between the piston and cylinder, release of the release member, locking the piston and cylinder against relative displacement, and a lever pivotable to displace the release member.

3. A chair according to claim 2 including an actuating rod rotatably supported by the support plate and rotatable to cause the lever to pivot.

4. A chair according to claim 1 wherein the resilient pad means comprises a pair of resilient pads supported on slide surfaces said support plate to lie on opposite sides of the elongate member and to project above the upper extremity of the elongate member.

5. A chair according to claim 4 wherein said slide surfaces of the support plate define guide slots, and including for each pad a bolt extending through a corresponding guide slot into screw threaded engagement with the pad, to constrain the pad for movement along said slot and when the bolt is tightened to lock the pad to the support plate.

6. A chair according to claim 1 wherein the front edge portion of the elongate member is in the form of a planar tongue, and wherein the coupling means comprises a pocket secured to the front edge portion of the bearing plate, the tongue being force fitted into the pocket.

7. In a chair, a support plate, an elongate member having two opposite end portions and pivotally supported on the support plate, a back rest rigid with the elongate member at one end portion thereof, a seat portion pivotally secured to the elongate member at the other end portion, first means coupling the support plate and the one end portion of the elongate member to vary the angle of inclination of the back rest and second means coupling the support plate and the seat portion to vary theinclination of the seat portion

8. A chair according to claim 7 wherein the first means comprises a piston and cylinder assembly.

9. A chair according to claim 7 wherein the second means comprises resilent pad means slidably mounted on the support plate slidable in a sense to vary the relative inclination between the seat portion on the support plate.

* * * * *